United States Patent [19]

Fenner et al.

[11] 4,274,627

[45] Jun. 23, 1981

[54] EXERCISE APPARATUS

[76] Inventors: Robert M. Fenner, Rte. 3, Box 156, Conifer, Colo. 80433; Edward P. Franz, 3764 Avocado Blvd., La Mesa, Calif. 92041

[21] Appl. No.: 86,688

[22] Filed: Oct. 22, 1979

[51] Int. Cl.[3] ..... A63B 23/02

[52] U.S. Cl. ..... 272/117

[58] Field of Search ..... 272/93, 117; 46/43; 273/294, 396, 322, 397, 1.5 A

[56] References Cited

U.S. PATENT DOCUMENTS

| | | | |
|---|---|---|---|
| 1,496,387 | 6/1924 | Smith | 46/43 |
| 2,060,938 | 11/1936 | Johnson | 272/117 |
| 2,372,333 | 3/1945 | Morelli | 46/43 |
| 3,145,992 | 8/1964 | McClung | 273/402 |
| 3,233,896 | 2/1966 | King | 273/1.5 A |
| 3,481,601 | 12/1969 | Sanfora | 273/54 R |
| 3,496,669 | 2/1970 | Siggelkow | 46/43 X |
| 3,814,421 | 6/1974 | Spier | 273/396 |
| 3,917,263 | 11/1975 | Wiley | 273/1.5 A |

*Primary Examiner*—Richard J. Johnson

*Attorney, Agent, or Firm*—Edwin L. Spangler, Jr.

[57] ABSTRACT

This invention relates to an apparatus for exercising the human body characterized by an elongate curved tubular chute open at both ends for insertion or retrieval of a ball placed therein that is mounted for propeller-like rotational movement about a substantially horizontal axis located approximately midway between its ends. The chute is slit longitudinally to receive the user's hands as he or she stands in front of its concave face and places a ball in one open end while retrieving it from the other or occasionally the same end. The chute is preferably mounted on a support which provides for vertical adjustment thereof and either slow powered rotational movement or securing thereof in any selected rotational position between vertical and horizontal.

11 Claims, 4 Drawing Figures

EXERCISE APPARATUS

Along with the ever-increasing national and even international emphasis upon physical fitness, more and more exercise equipment of one sort or another has found its way into the marketplace. Unfortunately, with but very few exceptions, this equipment is what can be characterized as "passive" for lack of a better term in that the user always maintains full control over how much physical energy is expended, what muscles are exercised, etc. Examples of such equipment are barbells, jump ropes, and a variety of very complex and expensive exercise machines which provide the user with a great number of body-building options all of which can be performed on a single piece of equipment. In each of these pieces of equipment, the options of "how much", "how many" and "how often" remain strictly within the control of the user.

These remains a different type of exercise device which, while remaining under the control of the user, also includes a second dimension not found in the passive devices as previously characterized, namely, the inherent capability of driving the user to a given preselected level of exertion once placed in operation. Probably the best example of what will be denominated here as an "active" device is a motorized treadmill. To be sure, the user controls his destiny so to speak in that he or she can set the machine at whatever speed and angle of inclination is desired just as with the passive equipment. For present purposes, however, the difference comes in how the user is forced to respond to the active equipment once it is set in motion. Taking the treadmill again as an example, once started, the user has no choice but to keep up with its preset pace or terminate the exercise. It is to such a class of active exercise equipment that the present invention relates.

The fundamental principle involved is a simple one, specifically that of placing a ball in one end of a tube and retrieving it from the other. Various pieces of equipment for returning a thrown ball to the user are found in the prior art, probably the best known being the ball return troughs alongside a bowling lane. Other such equipment can be found in U.S. Pat. Nos. 3,917,263; 3,233,896; and 3,145,992, all of which have stationary chutes of one design or another capable of returning or otherwise directing a thrown basketball back to the user or another player once it has passed through the hoop. Siggelkow's U.S. Pat. No. 3,496,669 shows a segmented ball race consisting of interconnectable straight and curved sections that can be fastened together in any desired order to define a circuitous cage-like track for the passage of a marble or other small ball. All of the ball chutes disclosed in the foregoing patents are stationary and remain fixed while being used. While Siggelkow's segmented race is adjustable in the sense that it can be set up in various configurations to suit the wishes of the builder, once in use it too remains stationary.

The only prior art patent known to applications that teaches a ball delivery chute which is adjustable during use in the U.S. Pat. No. 3,481,601 granted to Santora. The chute forming the subject matter of this patent is manually tiltable to vary the slope of the incline down which a bowling ball is delivered onto the lane. None of these patents or any other prior art ball chute, patented or not, discloses an open-ended chute mounted for pivotal movement about a substantially horizontal axis intermediate its ends which permits the position of the chute to be varied in propeller-like fashion anywhere between a horizontal and a vertical orientation relative to the ground. In addition, the apparatus includes means for continuously, but slowly, rotating the chute about its axis of rotational movement while it is being used. Moreover, the chute itself is so designed that the insertion and retrieval of the ball are facilitated while, at the same time, the possibility of accidental contact with the end thereof resulting in injury to the hands or forearms is greatly reduced.

It is, therefore, the principal object of the present invention to provide a novel exercise device.

A second objective is the provision of a device of the type aforementioned which has as its prime purpose that of forcing a particular and predetermined response from the user or a series thereof.

Another object is to provide a piece of active exercise equipment utilizing a ball return chute which, upon being activated by placing a ball therein, demands a known physical activity but one which can be performed over a lesser or greater time interval depending upon the degree of exertion one wishes to put into the activity.

Still another objective of the within described exercise apparatus is that of providing a piece of equipment that can be used to advantage by any age group and set to a level commensurate with their degree of physical fitness.

An additional object of the instant invention is to provide an exercise machine which, while extremely simple, remains capable when used properly of enabling the user to perform a wide variety of muscle-building and body-toning exercises while, at the same time, stressing the cardiovascular system to any level desired.

Further objects are to provide a piece of exercise equipment which is safe, reliable, compact, portable, versatile, relatively inexpensive, rugged and even somewhat decorative.

Other objects will be in part apparent and in part pointed out specifically hereinafter in connection with the description of the drawings that follows, and in which.

Figure 1:
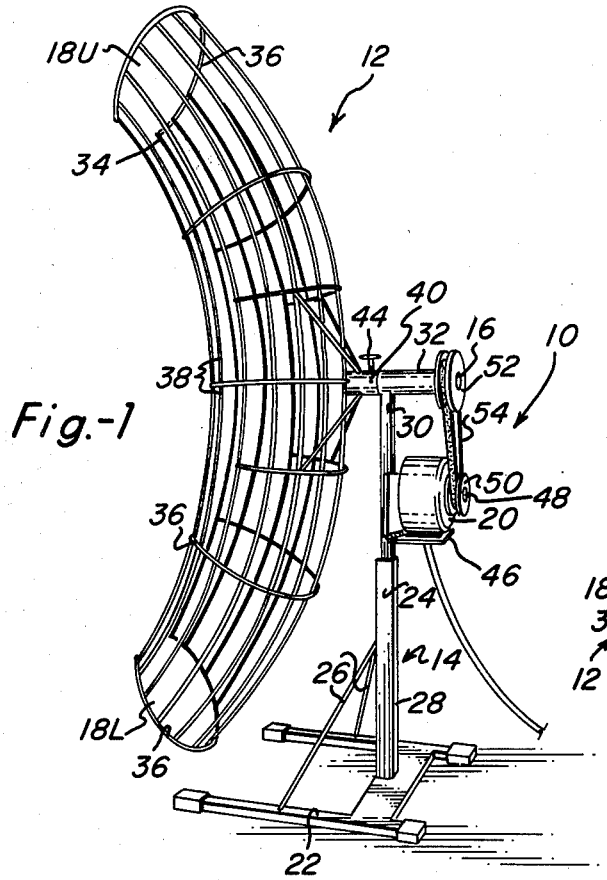
FIG. 1 is a perspective view of the exercise apparatus as it would appear from a position to one side thereof and slightly to the rear.

Referring next to the drawings for a detailed description of the exercise apparatus of the present invention, it has been designated broadly by reference numeral 10 and will be seen to include a curved tubular chute and a stand therefor, both of which have been similarly designated by reference numerals 12 and 14, respectively. Stand 14 may take any one of a number of forms including a more or less permanent will mount of the type demand appropriate for a fixed installation such as might be found in a gym or exercise room. The primary purpose of the stand is that of supporting the chute for propeller-like rotational movement about horizontally-disposed axis 16 (best seen in FIG. 4) located approximately midway between open ends 18U and 18L thereof. A secondary, but nonetheless significant function of the stand 14 is to carry electric motor 20 (again best seen in FIG. 4) of the motorized version. For purposes of versatility in the sense of accommodating users of various heights, the axis of rotation 16 of the chute is preferably made vertically adjustable which, of course, can be accomplished in many ways in either a fixed or portable installation.

Stand 14 of the portable apparatus illustrated is intended as being illustrative of one type of support for the chute 12 that might well be used to advantage in those situations such as the home when the unit needs to be moved and stored out of the way on occasion. It has a base 22 of conventional design for resting on the floor or other suitable supporting surface and an upstanding rigid post or mast 24 fastened in upright position atop the base. Struts 26 of standard design brace the mast against the overhanging load imposed therein by the chute and drive, if any, therefor. In the particular form illustrated, mast 24 is of the telescoping type having a fixed lower section 28 into which telescopes a movable upper section 30. Suitable means (not shown) are provided on the mast for maintaining same in vertically-adjusted position. The shaft 16 that defines the horizontally-disposed axis of rotation is journalled for rotation within a sleeve 32 fixed to the top of the mast. This shaft is employed in a manner which will be explained presently to rotate the chute.

Figure 2:
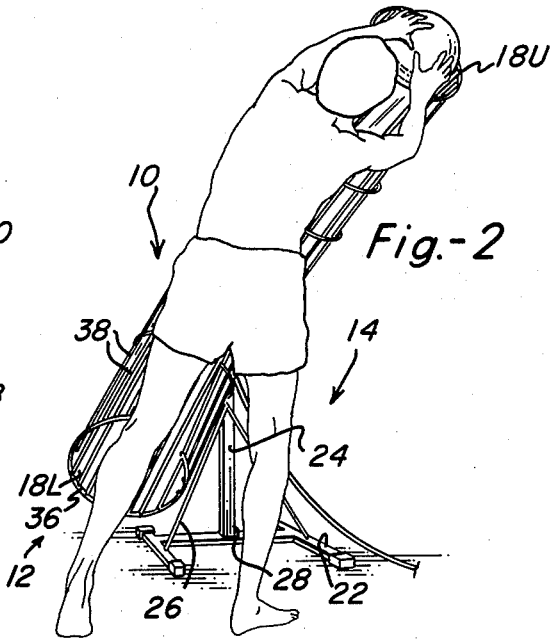
FIG. 2 is a perspective view illustrating a user inserting a ball in the open upper end of the exercise apparatus.
Figure 3:
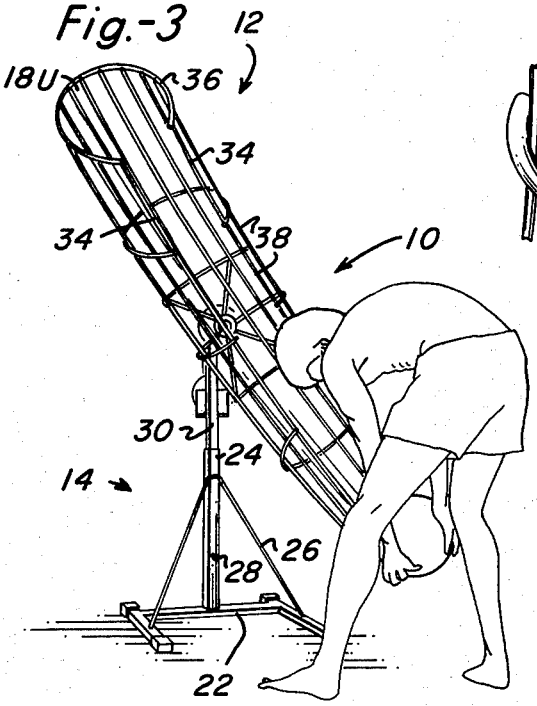
FIG. 3 is a perspective view similar to FIG. 2 and, once again, to the same scale but differing therefrom in that the user is shown bent over retrieving the ball from the lower open end to which it has rolled; and, FIG. 4 is a perspective view to a greatly enlarged scale showing the details of the chute drive, portions having been broken away to more clearly reveal the construction.
Figure 4:
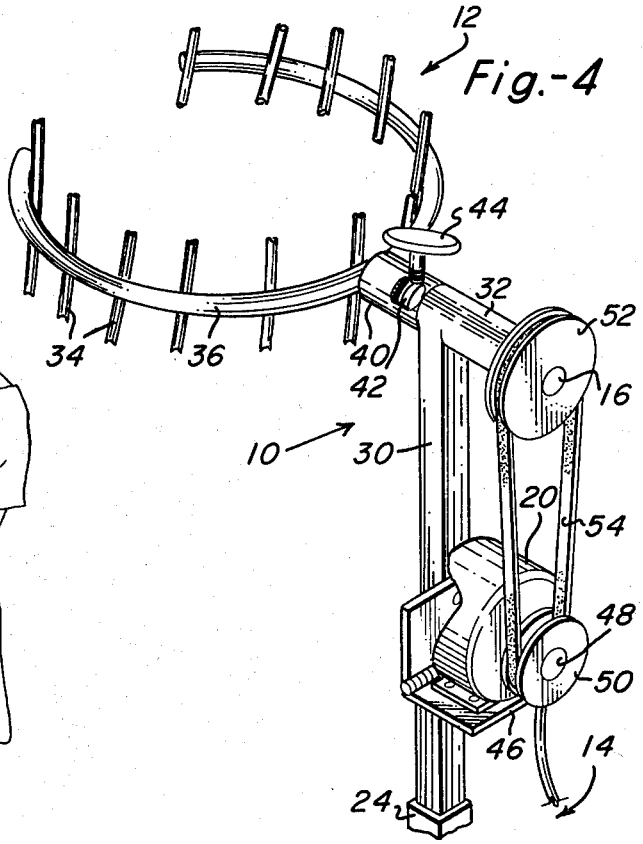

The chute 12 is tubular and adapted to receive a ball like, for example, a basketball placed in the upper open end 18U thereof and deliver same out the lower open end 18L. For this purpose, the size of the chute can either remain more or less constant from one end to the other as shown or, alternatively, be flared slightly at both ends to facilitate loading the ball therein. In either event, no useful purpose is served by varying the size of the medial portion. For purposes of the present invention, the chute should be curved and preferably also slit longitudinally along its concave face as identified by reference numeral 34. The purpose of this slit is to permit insertion and retrieval of the ball from the open ends with less danger of contacting the chute with the hands and also to allow the user to get ahold of the ball before it gets all the way to the end. To retain the ball, the width of the slit must, obviously, be less then its diameter; however, as shown in FIG. 4 one subtending an angle of something between approximately 60° and 90° has proven perfectly adequate while remaining wide enough for insertion of both hands in side-by-side relation as shown in FIGS. 2 and 3.

While the chute should be substantially curved and not straight, the degree of curvature is not critical. Tests have shown that it should, for best results, be somewhat less than 90° in angular extent yet greater than 45°. When curved through an arc of about 60°, both open ends are readily accessible to a user either facing same or with his or her back thereto. Also, this degree of curvature insures that the ball will move rapidly therethrough especially in vertical position, yet, will not progress nearly as fast as if in a state of free fall. In other words, a user in good physical condition will easily be able to place a ball in the upper open end 18U as shown in FIG. 2 and bend down in time to retrieve it from the lower open end 18L as in FIG. 3 with the chute steeply inclined. Lesser inclinations approaching the horizontal, of course, slow down the travel of the ball through the chute and thus give the user more time to move into position to retrieve same.

The overall height of the chute should at least equal that of the user and preferably exceed it somewhat so that he or she must reach above their heads to insert the ball with the chute in vertical position and bend down almost to the floor when retrieving it. Here, of course, the overall height becomes largely a matter of choice so long as its upper end can be reached conveniently and its lower end clears the floor. The height considerations, therefore, are more a matter of maximizing the physical involvement of the user than anything else.

In the particular form shown, the chute is fabricated from a series of split metal rings or hoops 36 connected together by a plurality of spaced substantially parallel rods 38 which cooperate to define a cage-like structure. While, obviously, a solid-walled chute can be used with equally good results, the cage-like structure shown is much lighter and, therefore, easier to move around. Also, from an aesthetic standpoint, it is much more visually interesting for both the user and other observers to be able to watch the ball progress through the chute. While not shown, the hoop-like split rings 36 on the chute ends are preferably padded in some fashion such as by covering them with rubber because in the intense physical activity associated with use of the apparatus 10, the hands, wrists or forearms of the user will almost surely come into contact with one end or the other of the chute periodically despite the presence of slit 34. No novelty is, of course, predicated upon such a feature since it is well within the skill of the art to pad or otherwise protect areas of possible injury to a user.

With specific reference of FIGS. 1 and 3, it can be seen that a sleeve 40 is welded or otherwise permanently fastened to the chute at a point approximately midway between its ends. This sleeve is reinforced by braces 42 in the usual manner and rotates freely upon spindle 16. The placement of sleeve 40 midway between the ends of the chute is preferable since offsetting it toward one of the ends causes them to move in different circular arcs at different distances in front of the user. While such an arrangement will work and undoubtedly increases the degree of skill required to use the machine, tests have shown that it demands all the physical involvement one ordinarily seeks in an exercise machine without unnecessarily complicating it.

Shaft 16 telescopes into sleeve 40 as shown and journals the latter for relative rotational movement when the shaft itself is not being rotated by motor 20 and the user wishes to change the inclination of the chute relative to the floor. Shaft 40 contains an annular groove 42 and a set screw 44 threaded through the sleeve enters this groove to both hold the chute in assembled relation on the stand and to releasably lock the two together. Backing off the set screw, of course, enables the chute to be rotated propeller-fashion on shaft 16 while it remains stationary. Removal of the set screw, on the other hand, enables the chute to be disassembled from the stand.

Now, in the particular form illustrated, the upper telescoped section 30 of the stand carries a hinged platform 46 on the side thereof opposite that upon which the chute is located. Fastened to this platform is motor 20, the shaft 48 of which carries a V-belt pulley 50 as shown in FIG. 1. The rear end of shaft 16 also carries a V-belt pulley 52 which is operatively connected to the motor shaft pulley by V-belt 54. Pulleys 50 and 52 along with belt 54 and hinged platform 46 cooperate to define a common place "Rockwood" mount wherein the weight of the motor is used to maintain belt tension. In the present apparatus, the Rockwood concept serves yet another function, namely, that of holding the chute in its angularly-adjusted position when motor 20 is not running. In models of the exercise apparatus that are not motorized, shaft 16 can be fastened non-rotatably within sleeve 32. There are, of course, many ways of slowly turning the chute 12 in propeller-like fashion including manually that will readily occur to those skilled in the art, the particular drive shown being intended as illustrative of one such mechanism.

Finally, with detailed reference of FIGS. 2 and 3, a few of the many ways in which the exercise apparatus of the present invention can be used will be set forth in detail. The simplest and least strenuous exercise is to set the chute in nearly horizontal position, stand facing it and place the ball in the upper open end 18U while retrieving it from the lower open end. The ball courses its way slowly through the chute in this position but significant twisting motion of the body from side-to-side results with corresponding benefits to the user's waistline. Leaving the chute set in near horizontal position but turning one's back on the unit greatly increases the difficulty of the exercise since a much more complete body turn is necessary. Obviously, as the inclination of the chute gets steeper and steeper, the faster the ball moves therethrough and the quicker the response required of the user to retrieve it from the lower end. At the same time, the motion becomes more of a bending one than twisting until finally it is pure bending. With the chute vertical and the user's back facing it, the ball is placed in the chute back over the head and retrieved from between the legs. The vertical orientation of the chute is such that the ball traverses same quite rapidly and the exercise, therefore, becomes a fast and extremely vigorous one.

In the motorized version of the unit, the chute is rotated by means of motor 20 at a slow rate while the user is engaged in inserting and retrieving the ball therefrom. Obviously, each half revolution that has been designated here as the upper open end 18U changes and becomes the lower one 18L and vice versa. It will also be apparent that upon occassion during the course of a work out with the machine that the ball will come back out the same end in which it was just previously inserted. When this occurs and the user is ready to retrieve the ball at the opposite end, very quick shift in position is required to get the ball before it hits the ground or rolls away. The use of a variable speed motor adds a further dimension of difficulty to the apparatus since the amount of exertion required is almost directly proportional to the rotational speed of the chute. Add to this the far more difficult calisthenic performed with the user's back to the chute and it will be readily apparent that the apparatus is capable of pushing the human body to extreme limits. On the other hand, by leaving the chute stationary and nearly horizontal, a very modest degree of physcial exertion is demanded of the user.

What is claimed is:

1. Exercise apparatus comprising: support means defining a substantially horizontal axis of pivotal movement elevated above ground level, and a generally tubular chute open at both ends and mounted intermediate its ends for rotational movement upon said support means axis, said chute being curved with the concavity therein facing away from the support means, said chute having an arc of curvature lying between approximately 45° and 90°, and wherein the chute is slit longitudinally along the concavity therein, and said slit is of a width subtending an angle of substantially less than 180° so as to prevent removal of a ball from the chute except at its open ends.

2. The exercise apparatus as set forth in claim 1 including means interconnecting the support means and chute for releasably securing the latter in any selected angular position.

3. The exercise apparatus as set forth in claim 2 in which the means interconnecting the support means and chute comprises an electric motor drive operative when actuated to rotate the latter and when stopped to maintain same in a selected angular position.

4. The exercise apparatus as set forth in claim 1 wherein the chute is formed by at least three longitudinally-spaced hoops interconnected by longitudinally-extending rods cooperating with one another to define a cage-like structure.

5. The exercise apparatus as set forth in claim 1 wherein the overall height of the chute is no greater than that where an adult user of average height standing erect can reach up and place a ball in one open end thereof while the opposite open end is located therebeneath at approximately ground level

6. The exercise apparatus as set forth in claim 1 including drive means operatively interconnecting the support means and chute for rotating the latter.

7. The exercise apparatus as set forth in claim 1 wherein the axis of pivotal movement of the support means is vertically adjustable.

8. The exercise apparatus as set forth in claim 1 wherein the chute has an arc of curvature of less than 90° but greater than 45°.

9. The exercise apparatus as set forth in claim 8 wherein the chute has an arc of curvature of approximately 60°.

10. The exercise apparatus as set forth in claim 1 wherein the chute has a generally circular cross section and the slit therein subtends an angle of between approximately 45° and 90°.

11. The exercise apparatus as set forth in claim 1 wherein the chute is sized to accept a basketball and the slit therein is of a width sufficient to accommodate the user's hands reaching through said slit to grasp a ball within the chute.

* * * * *